US006669507B2

(12) United States Patent
Yamanashi et al.

(10) Patent No.: US 6,669,507 B2
(45) Date of Patent: Dec. 30, 2003

(54) CONNECTOR

(75) Inventors: Makoto Yamanashi, Shizuoka (JP); Takao Murakami, Shizuoka (JP); Chieko Torii, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/120,379

(22) Filed: Apr. 12, 2002

(65) Prior Publication Data

US 2002/0151215 A1 Oct. 17, 2002

(30) Foreign Application Priority Data

Apr. 16, 2001 (JP) ..... 2001-116937

(51) Int. Cl.[7] ..... H01R 13/422
(52) U.S. Cl. ..... 439/595
(58) Field of Search ..... 439/595, 752

(56) References Cited

U.S. PATENT DOCUMENTS

| | | | | |
|---|---|---|---|---|
| 4,571,017 A | | 2/1986 | Fujita | |
| 5,601,454 A | | 2/1997 | Suzuki et al. | |
| 5,645,452 A | | 7/1997 | Kodama | |
| 6,048,225 A | * | 4/2000 | Dechanteloup et al. | 439/595 |
| 6,193,551 B1 | * | 2/2001 | Yamamoto et al. | 439/595 |
| 6,244,900 B1 | * | 6/2001 | Ishikawa et al. | 439/595 |
| 6,322,391 B1 | * | 11/2001 | Kodama | 439/595 |

FOREIGN PATENT DOCUMENTS

| | | |
|---|---|---|
| JP | 5-121116 | 5/1993 |
| JP | 8-7969 | 1/1996 |
| JP | 8-31493 | 2/1996 |
| JP | 2000-58180 | 2/2000 |

* cited by examiner

*Primary Examiner*—Gary Paumen
(74) *Attorney, Agent, or Firm*—Armstrong, Kratz, Quintos, Hanson & Brooks, LLP

(57) ABSTRACT

A terminal anchoring lance 20 includes a first anchoring portion 21 and a second anchoring potion 22 which are arranged apart from each other in a direction of inserting a female terminal 30. The female terminal 30 includes a first engagement portion 33 corresponding to the first anchoring portion and a second engagement portion 36 corresponding to the second anchoring portion. The second anchoring portion is arranged at the base 20*b* of the terminal anchoring lance or on the wall of a connector housing 11 on the extending line of the terminal anchoring lance. The first anchoring portion is formed as a tip of the terminal anchoring lance, and the second anchoring portion is formed as a projection. The second engagement portion is formed as a projection at the rear end of a female electrical contact portion 31 of the terminal, and the first engagement portion is formed as a projection at the front end of the electrical contact. A pair of the second anchoring portions are formed on both sides 20*c* of the terminal anchoring lance. In this configuration, the size and weight of a connector and the production cost of the connector are reduced. The number of components is also reduced without lowering the holding force of a female connector.

6 Claims, 4 Drawing Sheets

CONNECTOR

BACKGROUND OF THE INVENTION

1. Field of the Invention

This invention relates to a connector capable of doubly anchoring a terminal within a connector housing.

2. Description of the Related Art

FIG. 7 shows a conventional connector disclosed in JP-A-2000-58180 which is a prior art related to the connector.

A connector 101 includes a connector housing 102 of synthetic resin, a front holder 120 of synthetic resin which is fit in a front end opening 103 of the connector housing 102, female terminals 125 each to be inserted in each of terminal chambers 105 of the connector housing 102, and a terminal anchoring spacer 140 of synthetic resin which is inserted orthogonally to the terminal chamber 105 from an opening in a lower wall 102*b* of the connector housing 102.

The connector 101 constitutes a male connector which is fit into the fitting space of a complementary female connector (not shown) and locked using a locking arm 107. The female connector includes a connector housing with a fitting hood and a female terminal to be mated with the male terminal.

The connector housing 102 has three terminal chambers formed in a height direction. Each of the terminal chambers 105 is defined by left and right partition walls (side walls at the left and right ends) and upper and lower partition walls 106 (upper and lower walls at the upper and lower ends). The upper and lower partition walls 106 are communicated with sloping partition walls 141 which slope upwards in a forward direction of the terminal anchoring spacer 140.

The upper and lower partition walls 106 are each provided with a flexible terminal anchoring lance 110 at the front through the sloping partition wall 141 of the terminal anchoring spacer 140. The terminal anchoring lance 110 is formed to slope upward, and has a vertical anchoring face 110*a* (first anchoring portion) at the tip which cooperates with the first anchoring stage 129 at the front of the female terminal 125. A space which permits the terminal anchoring lance 110 to deflect is formed beneath the terminal anchoring lance 110. Incidentally, the expressions "upper and lower", "left and right" and "front and rear" are defined for convenience of explanation. Therefore, they do not necessarily accord with the directions when the connector is actually used. The expression "upper" refers to the side where a locking arm 107 for cooperating with a complementary female connector is provided; the expression "front" refers to the side where the connector is coupled with the complementary connector, and the expression "left and right" refers to the direction orthogonal to both the "left and right" and the "front and rear".

No upper and lower partition walls are formed in front of the terminal anchoring lance 110 to form an opening space passing vertically. At the front of the opening space, a square front opening 103 where the front holder 120 is mounted is formed. The front holder 120 is mounted in the front opening 103 using an anchoring means.

The front holder 120, which is a body separate from the connector housing 102, has four partition walls 121 which define the front side of the terminal chambers 105. The uppermost partition wall 121 is located in flush with the horizontal plane of the upper wall 102*a* of the connector housing 102. The lowermost partition wall 121 is located along the lower wall 102*b* of the connector housing 102. The intermediate two partition walls 121 are located in alignment with upper and lower walls 106 of the connector housing 102.

The partition walls 121 are provided perpendicularly to the wall 122 of the front holder 120, and an electric contact portion 126 of the female terminal 125 is accommodated between the upper and lower partition walls 121. In the wall 122 are formed a terminal insertion hole 123 corresponding to the electric contact of a complementary male terminal (not shown) and a jig insertion hole 124 for releasing the engagement between the terminal anchoring lance 110 and the female terminal 125.

In the configuration described above, since the connector housing 102 is provided with the front opening 103, the front opening 103 serves as a rapping hole or die-cutting hole. This facilitates the resin molding of the terminal anchoring lance 110 which is likely to generate insufficient filling because of its complicated shape, and improves the molding accuracy of the terminal anchoring lance 110.

The terminal anchoring spacer 140 includes upper and lower inclined partition walls 141 which define the terminal chambers 105 of the connector housing 102, another inclined partition wall 141 integral to the operation portion 142 at the lower end and side walls (not shown). The pitch between the partition walls 141 vertically arranged is equal to that between the upper and lower partition walls 106 of the terminal chamber 105. The terminal anchoring spacer 140 is inserted in a spacer inserting hole 112 which passes vertically through the terminal chambers 105.

The terminal anchoring spacer 140 is a body molded separately from the connector housing 102, but is used in a state where it has been inserted in the connector housing 102. The terminal anchoring spacer 140 is slidable vertically between a provisional anchoring position (state) and a final anchoring position (state). The provisional anchoring state refers to the state where the terminal anchoring spacer 140 has been pulled out downward so as to project from the lower wall 102*b* of the connector housing 102. In this provisional anchoring state, the female terminals 125 are inserted into the terminal chambers 105. Thereafter, the terminal anchoring spacer 140 is squeezed upward so that the female terminals 125 are completely anchored and preliminarily anchored. Thus, each of the female terminals 125 is anchored doubly by the terminal anchoring lance and the terminal anchoring spacer.

Some connectors do not employ the terminal anchoring spacer 140. In this case, the female terminals 125 are anchored by primary anchoring by the terminal anchoring lance 110.

The female terminal 125 includes an electric contact portion 126 at the front and a wire connecting portion 131 at the rear. The electric contact portion 126 is constructed of a box-shaped circumferential wall 127 and an elastic contact piece 128 located within the circumferential wall 127. The electric contact portion 126 has a first anchoring stage 129 cooperating with the terminal anchoring lance 110 formed at the front and a second anchoring stage 130 cooperating with the terminal anchoring spacer 140 formed at the rear. The wire connecting portion 131 is constructed of a front crimping piece 132 electrically connected by crimping the core 146 of the wire 145 and a rear crimping piece 133 fixed by crimping the cladding 147.

However, the above conventional connector provides the following problems to be solved.

One problem is that, since the connector 101 with the terminal anchoring spacer 140 inserted into the connector housing 102 requires a large number of components, the structure of the connector 101 becomes complicated and bulky.

Specifically, since there is a tendency for the number of electric components around the instrument panel of a motor vehicle to increase and for the space for arranging electric wires to decrease, it is desirable for the connectors to become compact. The above connector, which involves a large number of components, cannot satisfy such a requirement.

Another problem is that as the number of components increases, the production cost for the components increases. In addition, the operation of assembling the connector 101 requires a larger number of steps and the management of maintaining the accuracy of assembling the components becomes complicated. This is an obstacle of realizing the cost reduction.

However, if the terminal anchoring spacer 140 is abolished to miniaturize the connector 101, the female terminal 125 may easily come off from the rear. Specifically, the female terminal 125 is anchored only by the terminal anchoring lance. In this case, since the engagement margin between the first anchoring stage of the female terminal 125 and the terminal anchoring lance 110 is small and the terminal anchoring lance 110 has flexibility in both vertical and horizontal directions, if the wire 145 connected to the female terminal 125 is inadvertently pulled, the engagement may be lost.

Since the terminal anchoring lance 110 has a thin, lengthy and complicated shape, filling of resin may become insufficient in resin molding. In this case, it is further difficult to assure the engagement margin. This may reduce the force for holding the female terminal 125.

SUMMARY OF THE INVENTION

In view of the problems described above, an object of this invention is to provide a connector with no terminal anchoring spacer, and more particularly to a connector equipped with a terminal anchoring lance which can realize size and weight reduction and low cost based on the reduction in the number of components without reducing the holding force of a female terminal.

In order to attain the above object, there is provided a connector comprising:

- a connector housing having a terminal chamber;
- a terminal which is inserted into the terminal chamber from a rear opening of the connector housing; and
- a flexible terminal anchoring lance which is projected from an inner wall of the connector housing to anchor the terminal so that the terminal does not come off from the rear of the terminal chamber,
- wherein the terminal anchoring lance includes a first anchoring portion and a second anchoring portion arranged apart from each other in a direction of inserting the terminal, and the terminal includes a first engagement portion and a second engagement portion to be mated with the first anchoring portion and the second anchoring portion, respectively.

In the above configuration, since the terminal anchoring lance is provided with the first anchoring portion and the second anchoring portion to anchor the first engagement portion and the second engagement portion, respectively, the terminal is anchored at two points in a longitudinal direction. For this reason, the terminal once inserted into the terminal chamber of the connector housing does not come off from the rear. Since the terminal is doubly anchored without the terminal anchoring spacer which is a separate molded body, insufficiency of the holding force can be compensated for.

Preferably, the first anchoring portion is a tip of the terminal anchoring lance and the second anchoring portion is a projection formed at a side end of the terminal anchoring lance.

Preferably, the second anchoring portion is arranged at a base of the terminal anchoring lance.

In this configuration, since the second anchoring portion of the terminal anchoring lance is difficult to deflect in both vertical and lateral directions, the engagement margin between the second anchoring portion and the second engagement portion is assured to prevent the terminal from coming off from the rear.

Preferably, the second engagement portion is a projection formed at a rear end of a female electric contact of the terminal, and the first engagement portion is another projection formed at a front end of the electric contact.

Preferably, a pair of the second anchoring portions are formed at both side ends of the terminal anchoring lance.

In this configuration, if a pair of the second anchoring portions are formed at both side ends of the terminal anchoring lance, the pair of the second anchoring portions are engaged with the pair of the second engagement portions formed on both sides of the terminal so that even where the female terminal swings in the width direction, the loosening of engagement is prevented.

Preferably, the second anchoring portion is formed on the wall of the connector housing on an extending line of the terminal anchoring lance, the anchoring portion being flexible.

In this configuration, if the second anchoring portion is formed on the wall of the connector housing on an extending surface of the terminal anchoring lance, the engagement margin of the second anchoring portion can be assured without being affected by the swing of the terminal anchoring lance. Since the second anchoring lance is formed on the wall of fusible resin with good fluidity, poor molding such as insufficiency of filling is not generated in the second anchoring portion.

The above and other objects and features of this invention will become more apparent from the following description taken in conjunction with the accompanying drawings.

DESCRIPTION OF THE PREFERRED EMBODIMENT

Figure 1:
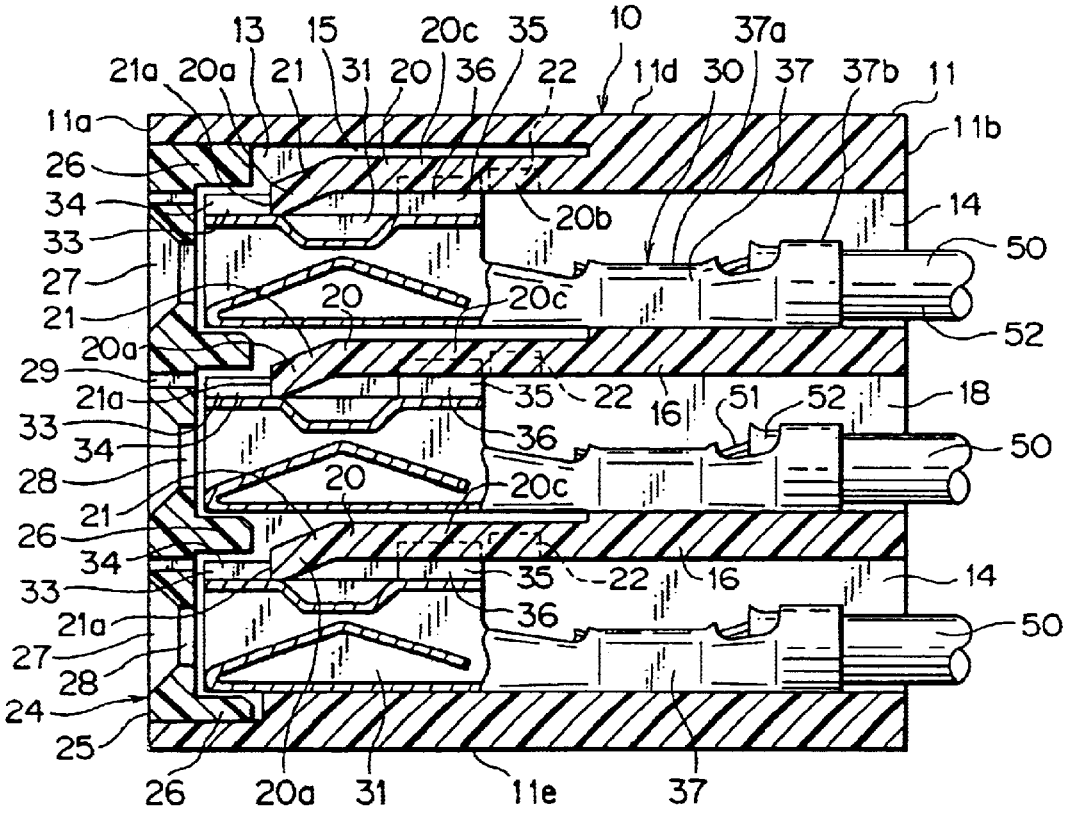
FIG. 1 is a sectional view of an embodiment of the connector according to this invention.

Now referring to the drawings, a detailed explanation will be given of an embodiment of this invention.

FIGS. 1 to 6 shows an embodiment of a connector according to this invention.

Figure 2:
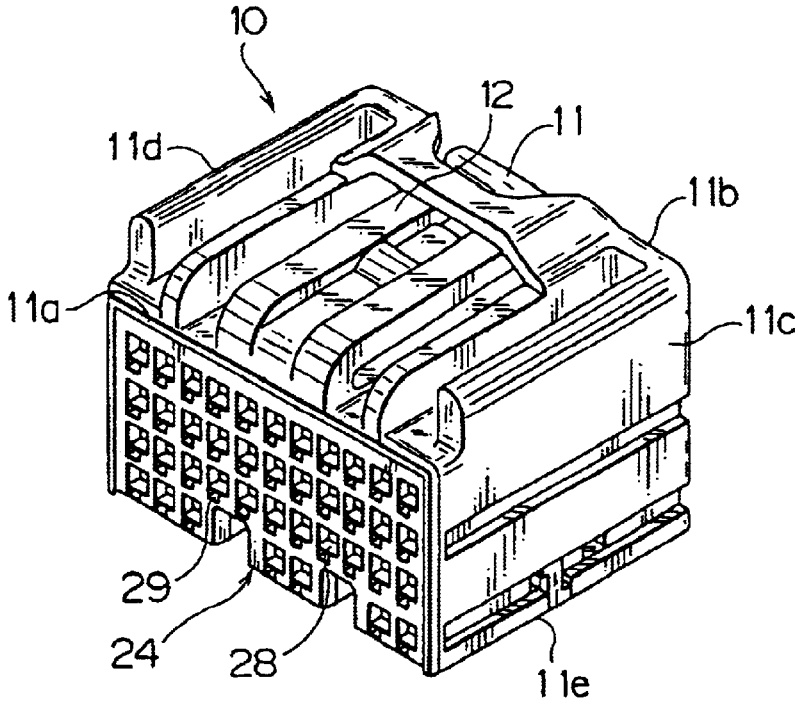
FIG. 2 is an entire appearance view shown in FIG. 1.

As seen from FIGS. 1 and 2, a connector 10 includes a connector housing 11 which is made of synthetic resin and incorporates terminal chambers 14, a front holder 24 which fits in a front opening 13 of the connector housing 11, female connectors 30 each of which is inserted into the corresponding terminal chamber 14 from each of rear openings 18, and terminal anchoring lances 20 each of which projects from the inner wall of the connector housing 11 to anchor an electric contact 31 of the female terminal 30 so that it does not come off from the rear.

The connector 10 serves as a male connector which fits into a complementary female connector (not shown). The connector 10 has substantially the same structure as that of the connector 101 but is different from the connector in that it is not provided with a terminal anchoring spacer 140.

Figure 7:
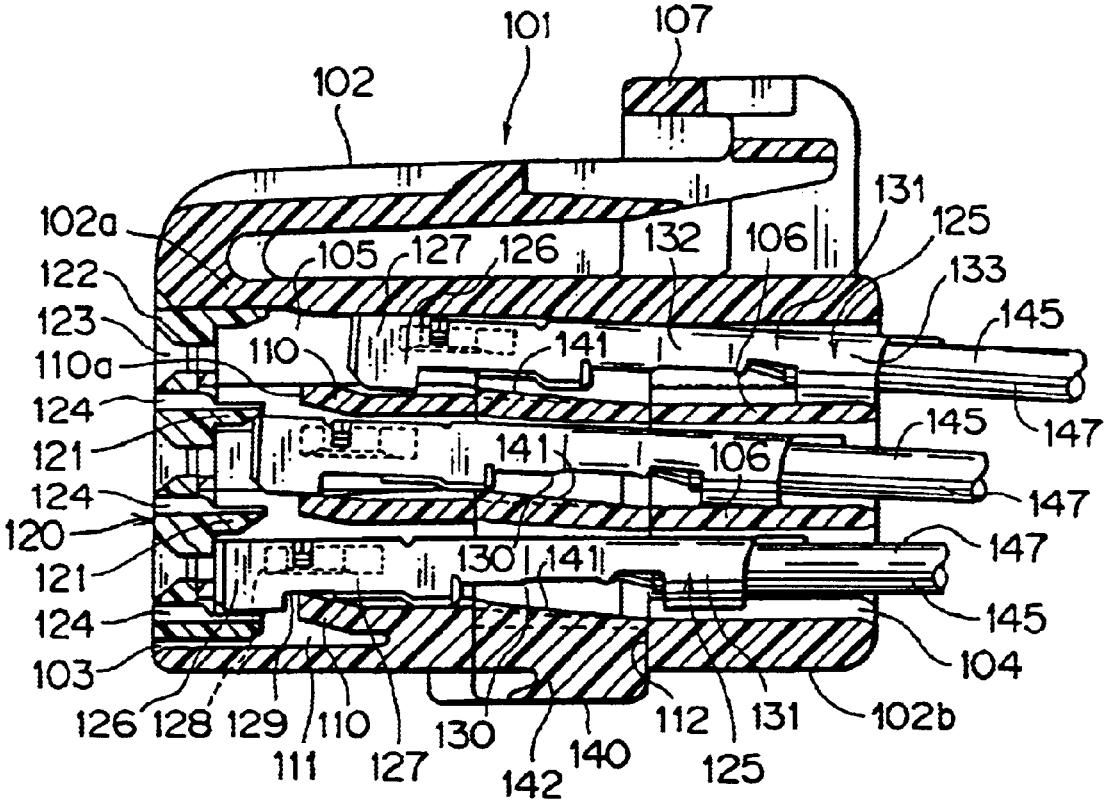
FIG. 7 PRIOR ART
FIG. 7 is a sectional view of a conventional connector.

The terminal anchoring spacer 140 (FIG. 7) is previously molded as a component separated from the connector housing 102. The terminal anchoring spacer 140 is inserted from the spacer inserting hole 112 in the upper wall 102*a* or lower wall 102*b* to anchor the female terminals 125 doubly. Therefore, the insertion of such a terminal anchoring spacer 140 increases the longitudinal length of the connector 101 so that the size of the connector is increased. The connector according to this invention does not require the terminal anchoring spacer 140 so that the connector 10 can be prevented from being enlarged and hence downsized.

Although already defined in relation to the prior art, the expressions "upper/lower", "left/right" and "front/rear" are defined here again. The "upper" in the "upper/lower" refers to the side where a locking arm 12 is provided for the complementary female connector (not shown), the "front" in the "front/rear" refers to the side where the connector fits in the complementary female connector, and the left/right refers to the direction orthogonal to the directions of the "upper/lower" and "front/rear".

The connector housing 11 includes three or four terminal chambers formed in a height direction. The number of the terminal chambers 14 should not be limited to three or four in this embodiment, but may be two or less, or five or more. Each terminal chamber 14 is defined by upper and lower partitions 16 (upper and lower walls lid and lie at the upper and lower ends), and left and right (widthwise) partitions 17 (side walls 11*c* at the left and right ends). The upper/lower partitions 16 and the left/right partitions 17 are not broken off, but continuously extend from the rear wall lib of the connector housing 11 toward the front.

Figure 3:
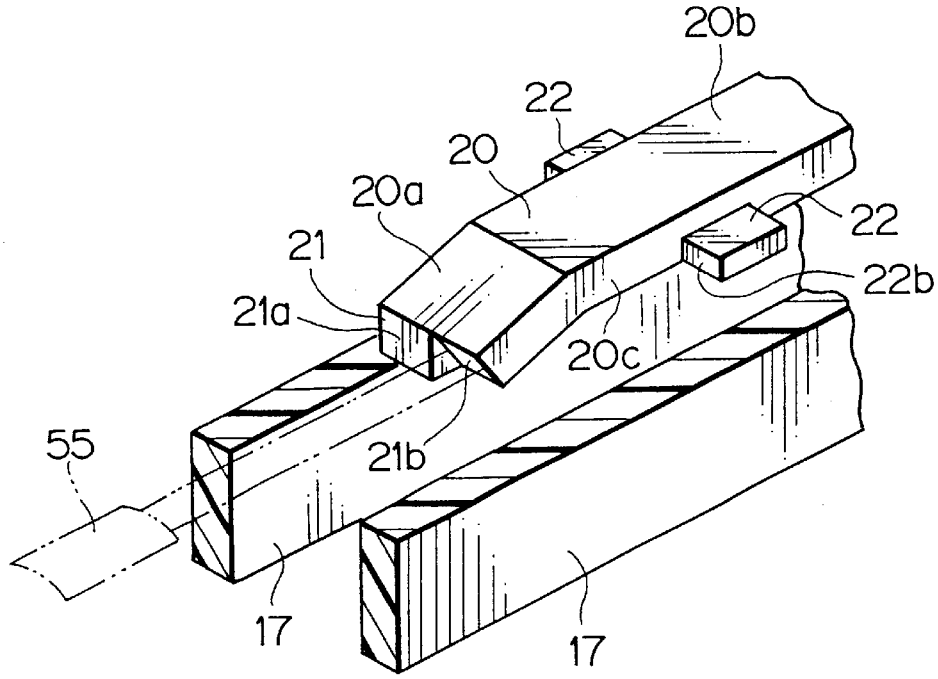
FIG. 3 is a perspective view of the main part of the terminal anchoring lance of the connector shown in FIG. 1.

As seen from FIGS. 1 and 3, a flexible anchoring lance 20 is integrally formed with the front of each of the upper/lower partitions 16. The front of the terminal anchoring lance 20 deflects inclinedly downwardly and its tip 20*a* serves as a first anchoring portion 21 for the front end portion 31 a of an electric contact 31 of the female terminal 30. The tip portion 20*a* is provided with a vertical anchoring face 21 a on its one lateral side and a jig receiving face 21*b* for a terminal extracting jig 55 on its other lateral side.

The terminal anchoring lance 20 is provided with a pair of second anchoring portions 22 at both sides 20*c* of the base 20*b*, which cooperate with the rear ends 31*b* of the electric contact 31 of the female terminal 30. The second anchoring portions 22 are projections which project laterally outwardly of the terminal anchoring lance 20.

The second anchoring portions 22 are provided as a pair on both sides for the reason that the two points on both lateral sides of the female terminal 30 are anchored to prevent the engagement from being lost when the female terminal 30 swings.

The first anchoring portion 21 and the second anchoring portions 22 are different from each other in their functions as well as the above structure. Specifically, the first anchoring portion 21 has a function of positioning the female terminal 30 in the longitudinal direction in addition to preventing the female terminal 30 from coming off from the rear. Namely, the first anchoring portion 21 is adapted so that it forward urges the female terminal 30 forward so as to be brought into contact with the wall 25 of the front holder 24.

On the other hand, the second anchoring portions 22 are adapted so that they can be brought into contact with the rear ends 31*b* of the electric contact 31 of the female connector and provide a slight gap from the rear ends 31*b*. Namely, the female terminal 30 is not positioned in the longitudinal direction. This is because the positioning in the longitudinal direction can be done by using either the first anchoring portion 21 or the second anchoring portions 22. Namely, the second anchoring portions 22 serve to anchor the female terminal 30 secondarily. The second anchoring portions 22 are effectively used in the case where the female terminal and hence the wire suffers from inadvertent pulling force so that the primary anchoring has been released.

The second anchoring portions 22 may be provided on the inner wall of the connector housing 11 on the extending surface of the terminal anchoring lance 20. This is because even when the terminal anchoring lance 20 deflects upward, the engagement margin between the second anchoring portions 22 and the second engaging portions 36 is not decreased and the reliability of anchoring is further improved, thereby preventing the female terminal 30 from coming off from the rear.

The structure wherein the terminal anchoring lance 20 is provided with the second anchoring portions 22 to anchor the female terminal 30 doubly is given in place of the terminal anchoring space 140 described in connection with the prior art. This structure prevents the connector 10 from being increased in size so that the connector 10 is miniaturized and prevents the number of components from being increased, thereby reducing the production cost of the connector 10.

Figure 4:
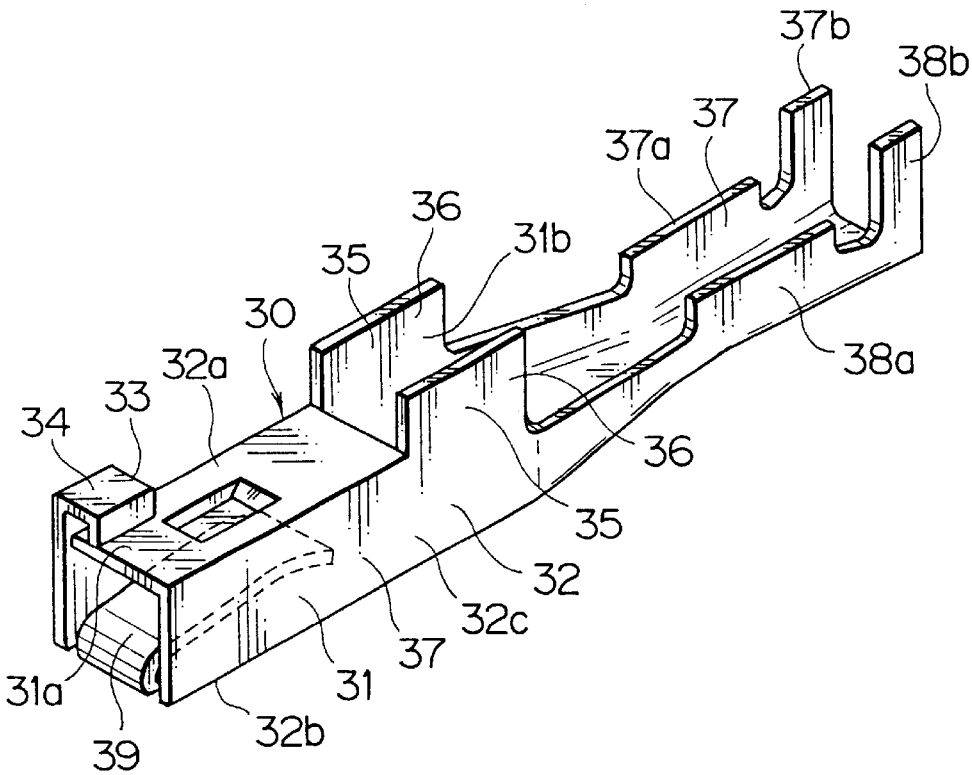
FIG. 4 is a perspective view of the female terminal accommodated in the connector.
Figure 5:
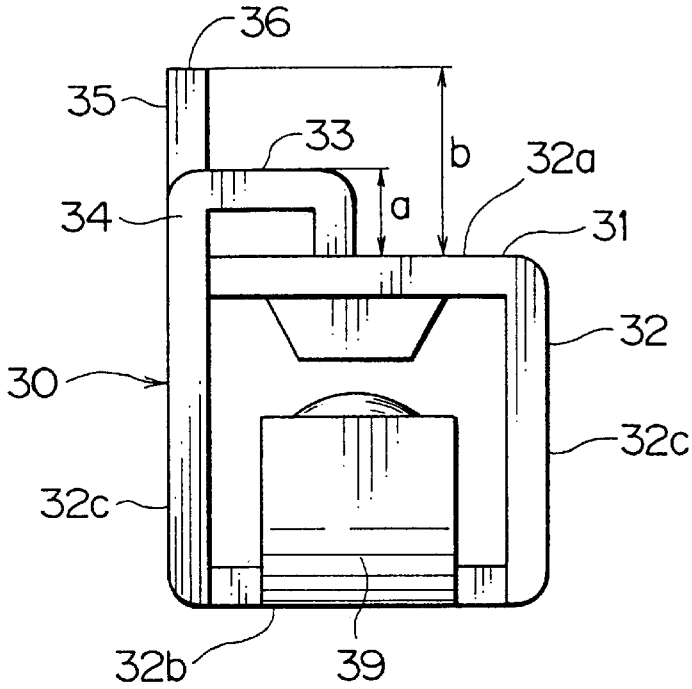
FIG. 5 is a side view of a female terminal shown in FIG. 4.
Figure 6:
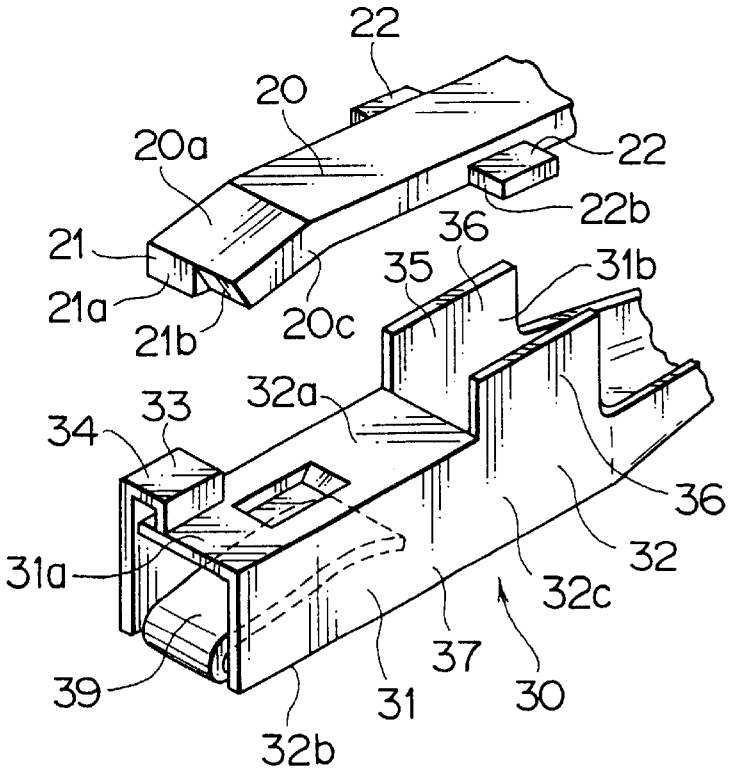
FIG. 6 is a perspective view for explaining the anchored state of the terminal anchoring lance shown in FIG. 3 and the female terminal shown in FIG. 4.

As shown in FIGS. 4, 5 and 6, the female terminal 30 is equipped with an electric contact portion 31 at the front and a wire connecting portion 37 at the rear. The wire connecting portion 37 has a cladding connecting portion 37*b* connected to the cladding 52 of the wire 50 by swaging the cladding 52 and a core connecting portion 37*a* electrically connected to the core 51 within the wire 50 by swaging the core. The cladding connecting portion 37*b* and the core connecting portions 37*a* are provided at the front and the rear of the wire connecting portion 37. The cladding connecting portion 37*b* and the core connecting portion 37*a* are constructed of a pair of swaging pieces 38*a* and 38*b*.

The electric contact portion 31 is provided with a box like peripheral wall 32 and an elastic contact piece 39 located inside the peripheral wall 32. The electric contact portion 31 is provided with a first engagement portion 33 formed at the front 31*a* for cooperating with the first anchoring portion 21 of the terminal anchoring lance 20. The electric contact portion 31 is provided with second engagement portions 36 having rear edges 31*b* that cooperate with the second anchoring portions 22 of the terminal anchoring lance 20.

The first engagement portion 33 is a box-like structure (projection) 34 which is formed by bending the extended portion of the peripheral wall 32 of the electric contact 31. The first engagement portion 33 has a contact face formed at the rear which is to be brought into contact with the anchoring face 21*a* of the first anchoring portion 21.

The second engagement portions 36 are upstanding pieces 35 which stand up from the peripheral wall 32 of the electric contact portion 31. The second engagement portions 36 have contact faces formed at the rear ends which are to be brought into contact with the second anchoring portions 22. The upstanding pieces 35 stand up along both side faces 32*c* of the peripheral wall 32 of the electric contact portion 31.

As seen from FIG. 5, the first engagement portion 33 has a projecting length a from the upper face 32*a* of the peripheral wall 32 and the second engagement portion 36 has a projecting length b therefrom. The projecting lengths a and b are in the relationship: b>a. The projecting length a includes an engagement margin for the first anchoring portion 21 of the terminal anchoring lance 20 represented by the vertical anchoring face 21*a* and the projecting length b includes an engagement margin for the second anchoring portion of the terminal anchoring lance 20 represented by the projections 22.

The projecting length a is set for a value within the elastic limit of the terminal anchoring lance 20. This is because the excessive deflection of the terminal anchoring lance 20 due to the insertion of the female terminal 30 is limited to prevent the plastic deformation of the terminal anchoring lance 20. If the terminal anchoring lance 20 deflects upwards beyond the elastic limit, it cannot elastically return to the original position.

Since the second engagement portion 36 projects in a greater degree than the first engagement portion 33 does, when the female terminal 30 is inserted, the front end of the second engagement 36 may interfere with the rear end of the second anchoring portion 22 to impede the insertion of the female terminal 30. However, the box-shape structure 34 of the first engagement portion 33 pushes up the terminal anchoring lance 20 to avoid the interference between the second engagement portion 36 and the second anchoring portion 22. The box-shape structure 34 is formed to be rigid so as not to deform.

Again referring to FIG. 1, in front of and above the terminal anchoring lance 20, a deflection space 15 is formed. The deflection space 15 extends vertically, laterally and longitudinally. The vertical and lateral deflection of the terminal anchoring lance 20 is permitted within the deflection space 15. In the forward deflection space 15, an opening space for the front holder 24 is formed to permit the front holder 24 to pass.

The front holder 24 serves to position the tip of the female terminal 30 to prevent the core from swinging and to guide the electric contact portion of the complementary male terminal (not shown) so that the female terminal 30 and the male terminal are accurately connected to each other. On the rear side of the front holder 24, i.e. on the wall 25 on the fitting side opposite to the opening space of the connector housing 11, four short partitions 26 are formed substantially vertically at regular intervals. The partitions 26 are located on the extended surfaces of the upper and lower partitions 16. The electric contact portion 31 can be supported between the adjacent upper and lower partitions 16.

On the wall 25 of the front holder 24, a terminal insertion hole 28 corresponding to the male terminal (not shown) and a jig insertion hole 29 of the terminal extracting jig 55 are formed. A sloping guide face 27 is formed so that its diameter is gradually enlarged toward the front end face. The sloping guide face 27 guides the electrical contact of the male terminal to correct the core swing. The remaining structure of the front holder 24 is substantially the same as that of the prior art, and will not be further explained.

What is claimed is:

1. A connector comprising:

a connector housing having a terminal chamber;

a terminal which is inserted into said terminal chamber from a rear opening of said connector housing; and a flexible terminal anchoring lance which is projected from an inner wall of said connector housing to anchor the terminal and prevent release thereof from the rear of the terminal chamber, wherein said terminal anchoring lance includes a first anchoring portion and a second anchoring portion arranged apart from each other in a direction of inserting said terminal, and said terminal includes a first engagement portion and a second engagement portion to be engaged by said first anchoring portion and said second anchoring portion, respectively, whereby both said first and second anchoring portions prevent release of the terminal from the rear of the terminal chamber.

2. A connector according to claim 1, wherein said first anchoring portion is a tip of said terminal anchoring lance and said second anchoring portion is a projection extending from a side surface of said terminal anchoring lance.

3. A connector according to claim 1, wherein said projection forming said second anchoring portion extends laterally from a base of said terminal anchoring lance.

4. A connector according to claim 1, wherein said second engagement portion of said terminal is a projection spaced rearwardly from a female electric contact of said terminal, and said first engagement portion is another projection formed at a forward portion of said electric contact.

5. A connector according to claim 1, wherein a pair of said second anchoring portions are formed on opposite sides of said terminal anchoring lance.

6. A connector according to claim 1, wherein said second anchoring portion is formed on an extending surface of said terminal anchoring lance and is flexibly deflectable therewith.

* * * * *